United States Patent [19]

Zollner

[11] 3,980,045

[45] Sept. 14, 1976

[54] APPARATUS FOR APPLYING LIQUID FINISHING AGENTS TO TEXTILE THREADS

[75] Inventor: Wolfgang Zollner, Dusseldorf, Germany

[73] Assignee: Henkel & Cie G.m.b.H., Dusseldorf, Germany

[22] Filed: Apr. 29, 1975

[21] Appl. No.: 572,738

Related U.S. Application Data

[62] Division of Ser. No. 447,636, March 4, 1974, Pat. No. 3,922,144.

[30] Foreign Application Priority Data

Mar. 5, 1973 Germany ..... 2310899

[52] U.S. Cl. ..... 118/50; 68/205 R

[51] Int. Cl.[2] ..... D06B 1/04

[58] Field of Search ..... 68/200, 205 R, 181 R, 68/184, DIG. 1; 118/50, 50.1; 427/294–298; 28/1.4, 75 R

[56] References Cited

UNITED STATES PATENTS

| | | | |
|---|---|---|---|
| 2,972,185 | 2/1961 | Brennan | 427/294 X |
| 3,364,050 | 1/1968 | Rausing | 427/296 X |
| 3,391,551 | 7/1968 | Hasler et al. | 68/200 X |
| 3,533,834 | 10/1970 | Marzocchi | 427/296 |

FOREIGN PATENTS OR APPLICATIONS

| | | | |
|---|---|---|---|
| 15,810 | 6/1970 | Japan | 68/184 |

*Primary Examiner*—Philip R. Coe
*Attorney, Agent, or Firm*—Hammond & Littell

[57] ABSTRACT

A process and an apparatus for the application of liquid freshening, brightening or finishing agents to textile threads or yarn, in which a free-falling jet of liquid is directed onto the threads with the additional use of reduced pressure.

3 Claims, 1 Drawing Figure

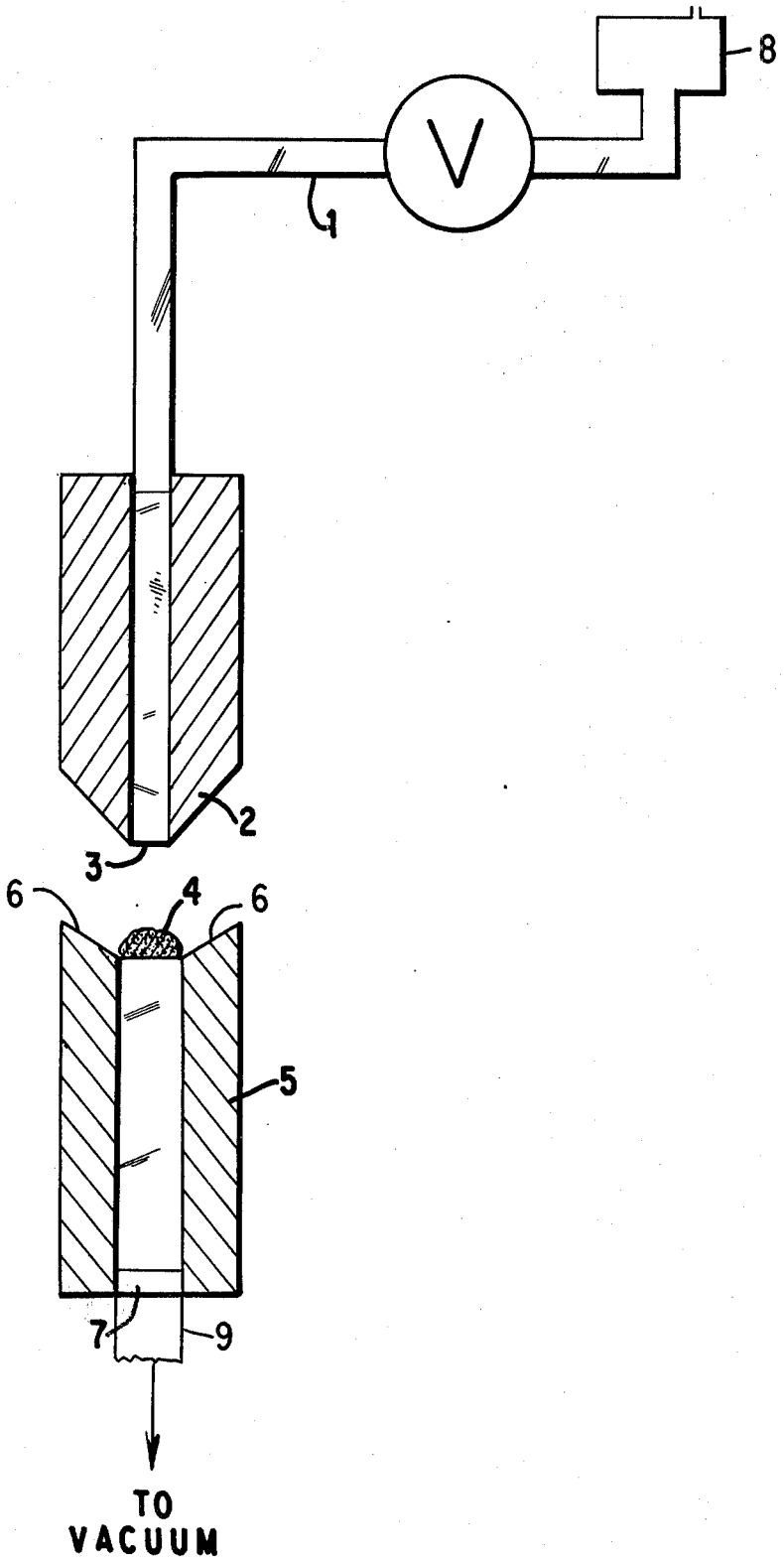
8
V
1
2
3
6
4
6
5
7
9
TO
VACUUM

APPARATUS FOR APPLYING LIQUID FINISHING AGENTS TO TEXTILE THREADS

This is a division of Ser. No. 447,636, filed Mar. 4, 1974, now U.S. Pat. No. 3,922,144.

THE PRIOR ART

It is known to dress or finish textile threads with liquid freshening agents by passing the threads over rollers which dip into a bath of the agent and transfer the liquid to the threads. This method of application has two significant disadvantages. On the one hand, it only partly succeeds in uniformly applying the agent to the threads. On the other hand, it has the intrinsic operational defect that, due to the high speed of the threads, the liquid is thrown off both directly behind the rotating rollers and also behind each place where the threads alter their direction; and thus the liquid can readily contaminate the machine. This disadvantage can only be avoided by an uneconomically slow rate of travel of the threads.

OBJECTS OF THE INVENTION

It is an object of the invention to provide an apparatus by which the aforesaid disadvantages are eliminated.

It is another object of the present invention to provide an apparatus for applying liquid freshening agents to textiles by which the finishing agent is uniformly distributed over the cross-section of the yarn after the treatment thereof, and by which the apparatus will not be contaminated by splashing of the finishing agent.

These and further objects of the present invention will become apparent as the description thereof proceeds.

DESCRIPTION OF THE INVENTION

The present invention relates to a process and an apparatus for the application of liquid freshening, brightening or finishing agents to textile threads or yarn, in which a free-falling jet of liquid is directed onto the threads with the additional use of reduced pressure.

The invention first of all relates to process and apparatus for the application of liquid freshening agents to textile threads, or yarn in which the agent in the form of a regulatable, free-falling jet of liquid, the diameter of which corresponds approximately to the diameter of the thread, is directed onto the threads which pass over a vacuum nozzle connected to a vacuum of 10 to 400 Torr and arranged coaxially to the jet of liquid, and the axis of the liquid jet is almost perpendicular to the axis of the thread.

More particularly the present invention is directed to a process for applying a liquid finishing agent to textile threads or yarn comprising directing a regulatable, free-falling jet of liquid finishing agent onto a moving textile yarn, the diameter of said jet corresponding approximately to the diameter of said yarn, passing said yarn over a suction zone maintained at a vacuum pressure of from about 10 to 400 Torr, said suction zone having an outlet arranged coaxially with said jet of liquid finishing agent, and the axis of said jet being approximately perpendicular to the axis of said yarn; and recovering said textile yarn finished with said liquid agent.

More particularly the present invention provides an apparatus for applying a liquid finishing agent to a textile thread or yarn comprising means containing a supply of liquid finishing agent; a nozzle means having an outlet for discharging said finishing agent onto a textile yarn and connected to said containing means, said discharge nozzle means mounted at approximately a right angle to the travel of said yarn, said outlet of said discharge nozzle having an interior diameter corresponding approximately to the diameter of said yarn; a regulating valve connected in series between said containing means and said discharge nozzle; and a suction means having an outlet positioned coaxially with said discharge nozzle at a distance below said discharge nozzle of about 1 to 10 times the diameter of said yarn, said suction outlet having an interior diameter about 0.5 to 2 times the diameter of said yarn, said suction outlet having a guide means over which said yarn passes and being connected to a vacuum means. The distance between the discharge orifice of said discharge nozzle and the suction orifice of said suction nozzle is thus between about ½ and 20 times the inside diameter of said suction orifice.

It has surprisingly been found that by directing a free-falling jet of liquid onto the thread, the diameter of the jet corresponding approximately to the diameter of the thread, good results are obtained if in addition the threads are passed over a vacuum nozzle arranged coaxially to the jet of liquid and connected to a vacuum of 10 to 400 Torr.

The present invention has the advantages that the quantity of freshening agent to be taken up by the threads can easily be adjusted in operation before its issue from the nozzle by the corresponding regulation in the flow rate of the liquid flowing, by alteration of the cross-section of the supply pipe. On the other hand, the regulatable vacuum additionally causes a corresponding alteration in flow rate of the freshening agent flowing from the supply pipe. Further, excess liquid is at the same time withdrawn by the vacuum into the suction nozzle and is therefore prevented from being splashed uncontrollably by the thread moving past at high speed. The liquid is sucked through the multifilament yarn; and consequently a very uniform distribution of the liquid throughout the cross-section of the yarn is attained.

The latter is therefore of particular advantage, since the time necessary for the prior art processes in which the freshening agent is diffused in the yarn and which generally takes a few hours, is reduced by the process according to the invention to the time of the momentary application; i.e. to less than 1 second. Yarns finished according to the invention can immediately be further processed, in contrast to the yarns finished by the prior art processes.

For carrying out the process, a suitable apparatus comprises a storage tank container for the product and devices for the feeding and the removal of the freshening agent. The apparatus according to the invention has a first nozzle for directing the freshening agent, fixed at approximately a right angle, or perpendicular, to the yarn, and connected in series to a regulating valve. The outlet diameter of this nozzle corresponds to about the diameter of the yarn. There is also a suction, or vacuum, nozzle located coaxially with the first nozzle at a distance about 1 to 10 times the diameter of the yarn below this first nozzle, equivalent to about 1 to 10 times the inside diameter of the first nozzle. This vacuum nozzle has a guide means over which the yarn travels; this vacuum nozzle is connected to a vacuum source, such as a suction pump; and the vacuum nozzle has a diameter which corresponds to about 0.5 to 2 times, preferably 1 to 2 times, the diameter of the yarn.

In another embodiment of the invention, it is possible to operate a relatively large number of these devices in parallel and in this manner ensure the simultaneous finishing of many textile yarns.

The apparatus according to the invention is illustrated in the following drawing which is not to be deemed limitative in any manner thereof.

The freshening agent flows from supply tank 8 through the supply pipe 1 to the nozzle 2. The amount supplied is adjusted by a regulating valve V. The nozzle 2 is mounted at right angles to the path of the yarn 4. The diameter of the outlet 3 of the nozzle 2 corresponds approximately to the diameter of the yarn 4. The suction nozzle 5 is coaxial with the nozzle 2, and if desired the axes are vertical, and the distance between the two nozzles 2 and 5 is about 1 to 10 times the diameter of the yarn. Furthermore the suction nozzle 5 contains the yarn guide 6. Moreover the nozzle 5 is connected to a source of vacuum by vacuum supply pipe 9. The diameter 7 of the suction nozzle 5 is somewhat larger than the diameter of the yarn 4. The jet of liquid discharged from the nozzle 2 falls freely onto the yarn 4. The vacuum in the nozzle 5, which is adjustable to between about 10 and 400 Torr, and preferably between 15 to 50 Torr, then pulls the freshening agent through the yarn 4 and thereby ensures a uniform distribution of the agent throughout the cross-section of the yarn.

In order to carry out the process according to the invention, the generally known freshening or finishing agents are used, which have known formulations. Examples of suitable agents include the following: sulfated or sulfonated derivatives of fats, oils, fatty acids or fatty alcohols; adducts of ethylene oxide or propylene oxide to fatty acids, fatty alcohols, alkyl phenols, glycols etc.; starch, polyvinyl alcohol, polyacrylic acid and other polymers. These agents are applicated in water, oils or organic solvents, e.g. mineral oil, chlorinated hydrocarbons etc. The solutions should have a viscosity of 2 to 500 cP.

In carrying out the process, the yarn passes over guide 6 of nozzle 5 which constitutes a suction zone at a speed between 500 to 2000 meters/min, preferably between 800 to 1000 meters/min, with the amount of freshener agent splashed or lost from the system being very minute, for example being less than 1% of the total agent utilized, and preferably less than 0.5% of the total agent utilized.

The amount of freshener agent taken up by the yarn will vary depending on the flow rate, viscosity and surface tension of the jet of freshener agent and the speed of the yarn.

The following examples are illustrative of the present invention without being limitative in any manner thereof.

EXAMPLE 1

1.2 kg of a commercial texturized endless yarn was finished with a freshener agent under the following conditions:

| Freshener agent | Adduct of 6 to 10 mols of ethylene oxide to decyl alcohol and nonyl phenol in mineral oil solution |
|---|---|
| Type of yarn | Polyester, 150/1, crude soft |
| Length of yarn | 720,000 m |
| Roller speed | 1000 m/min. |
| Viscosity of the freshener | 26 cP |
| Amount of freshener taken up by the yarn | 4.6% by weight |
| Amount of freshener splashed or lost | <0.1% |
| Uniformity of the application | 4.6% ± 0.2% |

The freshener finishing agent was discharged and directed onto the yarn in the form of a free-falling jet of liquid. The diameter of the jet corresponded to the diameter of the yarn. The yarn was itself passed over a suction nozzle which was connected to a vacuum of 25 Torr. The suction nozzle was arranged coaxial to the jet of liquid. The axis of the jet of liquid and the axis of the yarn were perpendicular and enclosed an angle of 90°.

The finishing agent was essentially uniformly distributed over the cross-section of the yarn after the treatment. The yarn could immediately be further processed. The machine was not contaminated by splashing of the finishing agent.

EXAMPLE 2

Under analogous operating conditions as in Example 1, 1 kg of a commercial polypropylene yarn was processed as follows:

| Freshener agent | sulfated castor oil in mineral oil solution |
|---|---|
| Length of yarn | 9000 m |
| Roller speed | 800 m/min. |
| Viscosity of the freshener | 113 cP |
| Amount of freshener taken up by the yarn | 3.1% |
| Amount of freshener splashed | 0.41% |
| Uniformity of the application | 3.1% ± 0.3% |

In this case there was essentially a uniform distribution of the finishing agent over the cross-section of the yarn. The yarn could immediately be further processed. The machine was not contaminated by splashing of the finishing agent.

Although the present invention has been disclosed in connection with a few preferred embodiments thereof, variations and modifications may be resorted to by those skilled in the art without departing from the principles of the new invention. All of these variations and modifications are considered to be within the true spirit and scope of the present invention as disclosed in the foregoing description and defined by the appended claims.

I claim:

1. Apparatus for applying a liquid finishing agent to a textile thread or yarn, comprising valved liquid finishing agent supply means, a finishing agent supply nozzle connected thereto to discharge liquid finishing agent downwardly as a free-falling jet; a suction nozzle positioned below said agent discharge nozzle and having a suction orifice coaxially in register with the discharge orifice of said finishing agent supply nozzle, said nozzles having substantially circular cross-sections, the inside diameter of said suction nozzle being substantially equal to the inside diameter of said supply nozzle; and a fiber guide at said suction orifice to maintain a moving thread or yarn in contact with said suction orifice; the distance between the discharge orifice of said agent discharge nozzle and the suction orifice of said suction nozzle being about ½ to 20 times the inside diameter of said suction orifice.

2. Apparatus according to claim 1 wherein said distance is about 1 to 10 times the inside diameter of said suction orifice.

3. Apparatus according to claim 1 wherein said discharge and suction nozzles are vertical.

* * * * *